US011692398B2

(12) United States Patent
Knolle

(10) Patent No.: US 11,692,398 B2
(45) Date of Patent: Jul. 4, 2023

(54) SONIC-POWERED METHODS FOR HORIZONTAL DIRECTIONAL DRILLING

(71) Applicant: Terra Sonic International, LLC, Marietta, OH (US)

(72) Inventor: L. Mark Knolle, Marietta, OH (US)

(73) Assignee: Terra Sonic International, LLC, Marietta, OH (US)

( * ) Notice: Subject to any disclaimer, the term of this patent is extended or adjusted under 35 U.S.C. 154(b) by 0 days.

(21) Appl. No.: 17/508,337

(22) Filed: Oct. 22, 2021

(65) Prior Publication Data

US 2022/0127908 A1 Apr. 28, 2022

Related U.S. Application Data

(60) Provisional application No. 63/104,231, filed on Oct. 22, 2020.

(51) Int. Cl.

| | |
|---|---|
| ***E21B 7/04*** | (2006.01) |
| ***E21B 7/24*** | (2006.01) |
| ***E21B 7/20*** | (2006.01) |

(52) U.S. Cl.

CPC ..... *E21B 7/046* (2013.01); *E21B 7/20* (2013.01); *E21B 7/24* (2013.01)

(58) Field of Classification Search

CPC ... E21B 7/046; E21B 7/20; E21B 7/24; E21B 7/30

See application file for complete search history.

(56) References Cited

U.S. PATENT DOCUMENTS

| | | | | |
|---|---|---|---|---|
| 2,903,240 | A * | 9/1959 | Mathewson, Jr. | E21B 7/24 175/320 |
| 3,283,833 | A * | 11/1966 | Bodine, Jr. | E21D 9/005 175/62 |
| 3,339,676 | A | 9/1967 | Bodine, Jr. | |
| 3,431,988 | A | 3/1969 | Bodine, Jr. | |
| 3,461,979 | A | 8/1969 | Newfarmer | |

(Continued)

FOREIGN PATENT DOCUMENTS

WO 2020132545 A1 6/2020

OTHER PUBLICATIONS

International Search Authority, Search Report and Written Opinion issued in PCT/US2021/056219 dated Jan. 11, 2022 (13 pages).

*Primary Examiner* — Jonathan Malikasim

(74) *Attorney, Agent, or Firm* — Wood Herron & Evans LLP

(57) ABSTRACT

A sonic-powered method is provided for horizontal directional drilling. The method includes positioning a drilling apparatus at one end of a desired path for a generally horizontal bore to be formed, and attaching a drill bit and a drill rod to a drill head. The method also includes advancing the drill bit and the drill rod into and through the ground along the desired path by advancing the drill head to move along the drill mast. A sonic oscillator of the apparatus applies sonic energy in the form of high frequency vibrations to the drill rod and the drill bit to cause the drill bit to penetrate through an underground formation in front of the drill bit along the desired path. The sonic vibrations help efficiently penetrate through different materials in underground formations. The drilling apparatus can also use sonic vibrations to install drill casings to stabilize the bore.

16 Claims, 12 Drawing Sheets

(56) References Cited

U.S. PATENT DOCUMENTS 4,384,625 A * 5/1983 Roper ..... E21B 7/04 166/301
4,784,230 A 11/1988 Cherrington et al.
5,148,875 A 9/1992 Karlsson et al.
5,165,491 A 11/1992 Wilson
5,553,680 A 9/1996 Hathaway
5,584,351 A 12/1996 Ellicott
5,720,354 A * 2/1998 Stump ..... E21B 47/13 175/45
5,816,345 A 10/1998 Keller
5,979,573 A 11/1999 Osadchuk
5,979,574 A * 11/1999 Osadchuk ..... E21B 7/046 175/353
6,109,371 A 8/2000 Kinnan
6,161,631 A 12/2000 Kennedy et al.
6,227,311 B1 5/2001 Osadchuk
6,343,663 B1 2/2002 Hill et al.
6,357,537 B1 3/2002 Runquist et al.
6,450,269 B1 9/2002 Wentworth et al.
6,536,539 B2 3/2003 Merecka et al.
6,736,219 B1 5/2004 White
6,772,134 B1 8/2004 Jacubasch et al.
6,886,644 B2 5/2005 Stump et al.
7,287,603 B2 * 10/2007 Hay ..... E21B 43/103 166/380
7,584,794 B2 9/2009 Butler et al.
7,588,099 B2 9/2009 Kracik
7,631,708 B2 12/2009 Billingsley
7,654,340 B2 2/2010 Self et al.
7,721,821 B2 5/2010 Carlson et al.
9,243,453 B2 1/2016 Koch et al.
9,523,240 B2 12/2016 Koch et al.
9,556,691 B2 1/2017 Van Zee et al.
9,598,905 B2 3/2017 Van Zee et al.
11,274,856 B2 * 3/2022 Berman ..... E21B 7/20
2004/0028476 A1 2/2004 Payne et al.
2009/0236146 A1 9/2009 Pierz
2015/0284932 A1 10/2015 Johnson
2017/0175461 A1 6/2017 Maurer et al.

* cited by examiner

SONIC-POWERED METHODS FOR HORIZONTAL DIRECTIONAL DRILLING

CROSS-REFERENCE TO RELATED APPLICATION

This application claims priority to U.S. Provisional Patent Application No. 63/104,231, filed Oct. 22, 2021. The above-mentioned patent application is incorporated herein by reference in its entirety.

TECHNICAL FIELD

The invention relates generally to underground boring and drilling applications, and more particularly, to methods using sonic energy to enhance capabilities of horizontal directional drilling technology.

BACKGROUND

Utility lines for various services such as water, electricity, gas, internet, communications and the like are often run underground for reasons of safety and aesthetics. One conventional method for providing such underground utility lines is by digging a trench and laying the lines into the opened trench, which is then back-filled following the installation. It is not always possible or desirable to install utility lines in this manner using trenches; as such construction methods have various disadvantages. For example, digging a trench can cause serious disturbance to existing structures or roadways, while also running risks of damage to pre-existing underground utility lines in the same area. During the installation work, the open trench poses a danger of injury to workers and others moving past the worksite.

Thus, an alternative technique of installing underground utility lines using horizontal directional drilling (HDD) has become a preferred alternative to trench-based installation operations in modern times. HDD, which is also known by other terms such as micro-tunneling, trenchless boring, and horizontal directional boring, generally involves first drilling a pilot bore into the ground at an acute/oblique angle with respect to the ground surface using a HDD machine, the pilot bore drilling generally involving circulation of drilling fluid (water/mud) to remove cuttings and allow for borehole advancement. The boring tool making the pilot bore is tracked in location and depth so that when the boring tool reaches the desired depth under the ground surface, the boring tool is then advanced horizontally along the desired path for the underground utility lines. At the end of the desired path, the boring tool is typically turned to move upwardly and then advanced until it breaks back through the ground surface. One or more reamers can be attached to and pulled by the drill string back through the pilot bore to make the borehole have a larger diameter, and a utility line or conduit can also be pulled through the borehole as a part of this process. The HDD results in underground utility line(s) being installed without necessitating trench digging, which can be particularly useful when such line(s) are to be installed under areas where trench digging is not possible or desirable, including under rivers, railways, major highways, environmentally sensitive areas, and urban environments, for example.

With reference to the schematic "Prior Art" overviews shown in FIGS. 1 and 2A-2C, a standard HDD process with a standard HDD drilling apparatus 10 typically begins with drilling a pilot bore 12 along a desired underground path. This is shown in FIGS. 1 and 2A, in this schematic example, the installed drill string 14 being shown behind the drill bit 16. Although these views show the bore path and pilot bore traversing a horizontal distance underneath a body of water, it will be understood that the bore path may be modified to traverse under or along whatever surface topology is present and needs to be worked around. The pilot bore is typically thereafter enlarged to a desired diameter and the walls thereof are conditioned as needed by pulling a larger cutting tool 18, sometimes termed a "reamer" or "back reamer," back through the pilot bore. This step is shown in FIG. 2B. Multiple reamers of increasing size can be pulled back through the pilot bore to further enlarge and condition the bore hole. Additionally, the product 20 (shown as a pipe 20 in FIG. 2C) may then be installed in the enlarged hole by way of being pulled behind a reamer, swabber, or the like as the drill string is retracted from the reamed bore. It is well understood that the accuracy of the resulting bore relative to the predetermined path directly relates to the accuracy of the initially drilled pilot bore. As a result, downhole movement tracking beacons referred to as a "sonde" or alternative tracking devices are typically used to track the progress of the drill bit to help an HDD rig operator properly guide the pilot bore to be along the desired path. The desired path may involve one or more turns along the length, e.g., bore holes are not necessarily always in a straight line path during the HDD process.

In a standard HDD operation, the drill bit of an HDD drill string engages with the substrate or underground formation to be bored and works to erode the substrate at the point of engagement during a boring process. One or more exhaust port(s) of the drill bit may be configured to expel a fluid, referred to as a drilling fluid, such that any eroded substrate at the point of engagement is cleared away from the drill bit assembly. Drilling fluid may be compressed air, a viscous liquid mixture of water and bentonite or polymer ("drilling mud"), or any other similar combination known to a person having ordinary skill in the art. During a boring process, the drilling fluid is typically continuously pumped to the drill bit and expelled from ports in the drill bit. The drilling fluid may be useful for holding eroded substrate particles in suspension and lubricating the bored channel for the drill string and/or the pulled product. Advantageously, these properties of the drilling fluid help stabilize the channel walls, cool the common drill bit, alleviate the pressure on the common drill bit and prevent a building-up of substrate particles at the common drill bit during the boring process. For example, a drilling mud helps keep the bore path open by building a sidewall cake and pressurizing the borehole with high viscosity fluids.

To this end, the use of a drilling fluid in this manner helps prevent the drill bit assembly from becoming clogged, which can restrict any necessary freedom of movement between the component parts. This also facilitates the circulation of the drilling fluid in the pilot bore, which is also typically used to cool the moving parts of the drill string. In such embodiments, the drilling fluid also facilitates the removal of previously eroded substrate from the channel along the drill string as the percussion boring process continues. It will be readily understood that this process consumes a significant amount of water/drilling fluid, especially for longer bore hole paths, and the handling, containment, recycling, and disposal of used drilling fluid fouled with the drill cuttings and other additives is a technical problem that must be addressed on every job site. For example, it is often necessary to use a large and complex solids treatment device or water recycling system 22 (or a separate set of holding tanks, fluid pumps, and mud separators) to allow for cleaning and potential recirculation of the water removed from the bore hole, in conjunction with the HDD rig and drilling equipment 10 (even though such elements are only schematically shown in "black box" form in the standard overview FIG. 1 for simplicity). In addition, as shown at least in FIG. 1, pits 24 typically need to be dug into the ground around the entry site to allow for collection and temporary retention of returned drilling fluids 26 from the bore hole. As set forth in detail below, the use of drilling fluid also generates a risk of "frac outs" in which the drilling fluids are expelled at the ground surface at a location not desired (e.g., between the entry and exit points), thereby creating potential safety and environmental contamination concerns. Two such examples of "frac outs" are shown in FIG. 2A, for example, with the drilling fluid expelled into and fouling either the river at reference 28 or the ground surface at reference 30. Nevertheless, the various beneficial functions achieved by using the drilling fluid (including bore hole stability) have long prevented HDD operators from transitioning to more "dry" drilling techniques when conducting HDD.

One exemplary downhole drill bit arrangement that may be conventionally used with HDD equipment and processes is now described. This drill bit arrangement uses a basic percussive cycle of hammering to advance the bore hole in HDD operation. The drill bit may be slidably engaged with a hammer via a chuck and spline. Air or hydraulic pressure is delivered to a piston and cylinder arrangement to cyclically drive the piston into repeated engagement with an impact surface on the drill bit. This percussive low frequency hammering action advances the drill bit, which may include cutting blades or carbide bits along leading edges thereof, into the material to be bored through while the drill string and drill bit is rotated. This process repeats continually to cause breakage and penetration through the underground formation in front of the drill bit, thereby advancing the bore hole as desired. It will be understood that the use of drilling fluid in such HDD operations can be necessary for the various functions noted above.

In any type of drilling or boring operation, including the aforementioned HDD, different geological formations and conditions can be encountered underground that need to be bored through to make the desired hole or path, in this case for the utility lines. Such different underground formations are shown by differing cross-hatchings in the ground shown in FIGS. 1 and 2A-2C. Especially in regions where the geological formations change along the desired path to be cut, conventional HDD machines and processes can struggle to efficiently complete the drilling and installation. Furthermore, the sourcing and handling (including disposal) of drilling fluids in the HDD process can be problematic, especially when utility line installation is taking place in developed areas such as built residential developments. Such problems have sometimes led to the older conventional trench-digging methods to be used in these circumstances, leading to more disruption and problems as set forth above.

It would therefore be desirable to provide improved methods of making HDD applications reliable and efficient regardless of the underground geological formations present, to address the various deficiencies and technical problems with conventional HDD designs and methods as outlined above.

SUMMARY

In order to address the various deficiencies noted above with conventional designs and methods, a sonic-powered method for horizontal directional drilling is provided in accordance with the embodiments of this invention. The method includes positioning a drilling apparatus proximate to an entry site at one end of a desired path for a generally horizontal bore to be formed. The drilling apparatus includes a drill head moveably mounted on a drill mast and a sonic oscillator operatively engaged with the drill head. A sonic drill bit and a sonic drill rod are attached to the drill head, and then the sonic drill bit and the sonic drill rod are advanced into and through the ground along the desired path by advancing the drill head to move along the drill mast. The sonic oscillator applies sonic energy in the form of high frequency vibrations to the sonic drill rod and the sonic drill bit to cause the sonic drill bit to penetrate through an underground formation in front of the sonic drill bit along the desired path. Then, the method includes attaching further sonic drill rods to the drill head and to previously-advances sonic drill rods, and repeating the advancing of the drill head to continue forming a generally horizontal bore by horizontal directional drilling (HDD) along the desired path until the sonic drill bit emerges at an exit site at an opposite end of the desired path. The generally horizontal bore that is formed defines a pilot bore for installing a line or conduit along the desired path. By using sonic drilling with HDD, drilling speed and efficiency is increased, and environmental and personnel safety is improved, while also eliminating some of the equipment that must normally be used with conventional HDD applications.

In one embodiment, the advancing of the sonic drill bit and the sonic drill rods into and through the ground is performed without a continuous circulation of a drilling fluid to the sonic drill bit and along the pilot bore. More specifically, the advancing of the sonic drill bit and the sonic drill rods into and through the ground can be accomplished in some embodiments without circulating any drilling fluid to the sonic drill bit or along the pilot bore. As a result, no fluid collection trench or water recycling equipment needs to be provided at the entry site and at the exit site.

In another embodiment, the desired path for the pilot bore travels through at least two different underground formations defined by differing materials to drill through. The advancing of the sonic drill bit and the sonic drill rods into and through the ground then includes using the same sonic drill bit to penetrate through each of the differing materials in the at least two different underground formations. A single set of drilling equipment including the same sonic drill bit and a single set of drilling operation parameters may then be used for penetrating the pilot bore through each of the at least two different underground formations.

In a further embodiment, one of the different underground formations is defined by sand material. In such a scenario, advancing the sonic drill bit and the sonic drill rods is done by suspending sand grains of the sand material in space using transmission of sonic vibrations from the sonic drill bit and the sonic drill rods into the sand material. This suspension of the sand grains generates a low friction environment for the sonic drill bit to advance through the sand material.

In yet another embodiment, one of the different underground formations is defined by clay material. In such a circumstance, advancing the sonic drill bit and the sonic drill rods is done by shearing the clay material surrounding the sonic drill bit and the sonic drill rods with transmission of sonic vibrations from the sonic drill bit and the sonic drill rods into the clay material. This shearing of clay material reduces friction against forward movements of the sonic drill bit and the sonic drill rods.

In another embodiment, one of the different underground formations is defined by rock material. In that case, advancing the sonic drill bit and the sonic drill rods is done by percussively fracturing the rock material by applying sonic vibrations to the sonic drill bit to cause repeated impacts of the sonic drill bit into the rock material, thereby removing the rock material in front of the sonic drill bit and reducing friction against forward movements of the sonic drill bit and the sonic drill rods.

In one embodiment, the method also includes attaching a sonic drill casing to the drill head, the sonic drill casing being larger in diameter than the sonic drill bit and sonic drill rods. The sonic drill casing is advanced into and through the ground so that the sonic drill casing surrounds the sonic drill rods and the pilot bore as the sonic drill casing is installed. The sonic oscillator applies sonic energy defined by high frequency vibrations to the sonic drill casing to cause the sonic drill casing to penetrate through underground formation(s) in front of the sonic drill casing. The method also includes attaching further sonic drill casings to the drill head and to previously-advanced sonic drill casing(s) and repeating the advancing of the drill head to continue casing the pilot bore, thereby stabilizing the walls of the pilot bore to prevent collapse of the pilot bore and/or to prevent escape of any drilling fluids used in the pilot bore.

In one example, the drill head alternates between advancing one sonic drill rod and then one sonic drill casing such that the majority of the pilot bore is stabilized and cased behind the sonic drill bit during the horizontal directional drilling, and wherein the drill head independently and separately applies the sonic energy to the sonic drill rods or to the sonic drill casings. The method may then further include inserting the line or conduit into the cased pilot bore and pulling the line or conduit through the pilot bore to finalize installation of the line or conduit along the desired path; and withdrawing the sonic drill casings using the drilling apparatus after the line or conduit is installed along the desired path.

The sonic oscillator produces high frequency vibrations of up to 150 Hz in the sonic drill bit and the sonic drill rods, or in the sonic drill casings. Moreover, the method may also include adjusting output of the sonic oscillator such that a frequency of the vibrations applied by the sonic energy on the sonic drill rods is a resonant frequency of the sonic drill rods or the sonic drill casings.

In another embodiment, the advancing of the sonic drill bit and the sonic drill rods further includes turning a forward direction of the sonic drill bit with a bent sub such that the desired path of the pilot bore includes one or more turns along a length of the desired path.

In a further embodiment, after the sonic drill bit emerges from the exit site to finalize formation of the pilot bore, the method includes attaching a reamer and/or a swabber to a free end defined by the sonic drill rods. The sonic drill rods are then withdrawn back through the pilot bore to advance the reamer and/or the swabber along the pilot bore. The sonic oscillator of the drilling apparatus continues to apply high frequency vibrations to the sonic drill rods to assist the reamer and/or the swabber to cut through the underground formations surrounding the pilot bore and thereby expand a size of the pilot bore. The pilot bore is then enlarged so as to be ready to fit the line or conduit to be installed along the desired path. The method can then include inserting the line or conduit into the expanded pilot bore and pulling the line or conduit through the pilot bore to finalize installation of the line or conduit along the desired path.

In yet another embodiment, advancing the sonic drill bit and the sonic drill rods includes a combination of: applying sonic energy with the sonic oscillator as described above, applying hydraulically-generated down pressure to move the drill head along a length of the drill mast towards the entry site, and slowly rotating the sonic drill bit and the sonic drill rods with the drill head during movement of the drill head along the length of the drill mast. This combination results in rapid and efficient movement to advance the pilot bore through many different types of underground materials and formations that may be encountered along the desired path.

The various features described in these embodiments may be combined in any combination or sub-combination without departing from the scope of this invention. The Sonic HDD method allows for quicker drilling of generally horizontal bores without necessitating significant use of drilling fluids that can lead to personnel or environmental hazards that need to be managed when conducting such drilling operations. Furthermore, the Sonic HDD methods can handle challenging variations in underground formations that a horizontal bore may need to be drilled through in certain settings.

BRIEF DESCRIPTION OF THE DRAWINGS

The accompanying drawings, which are incorporated in and constitute a part of this specification, illustrate one or more embodiments of the invention and, together with a general description of the invention given above, and the detailed description given below, serve to explain the invention.

DETAILED DESCRIPTION

Figure 1:
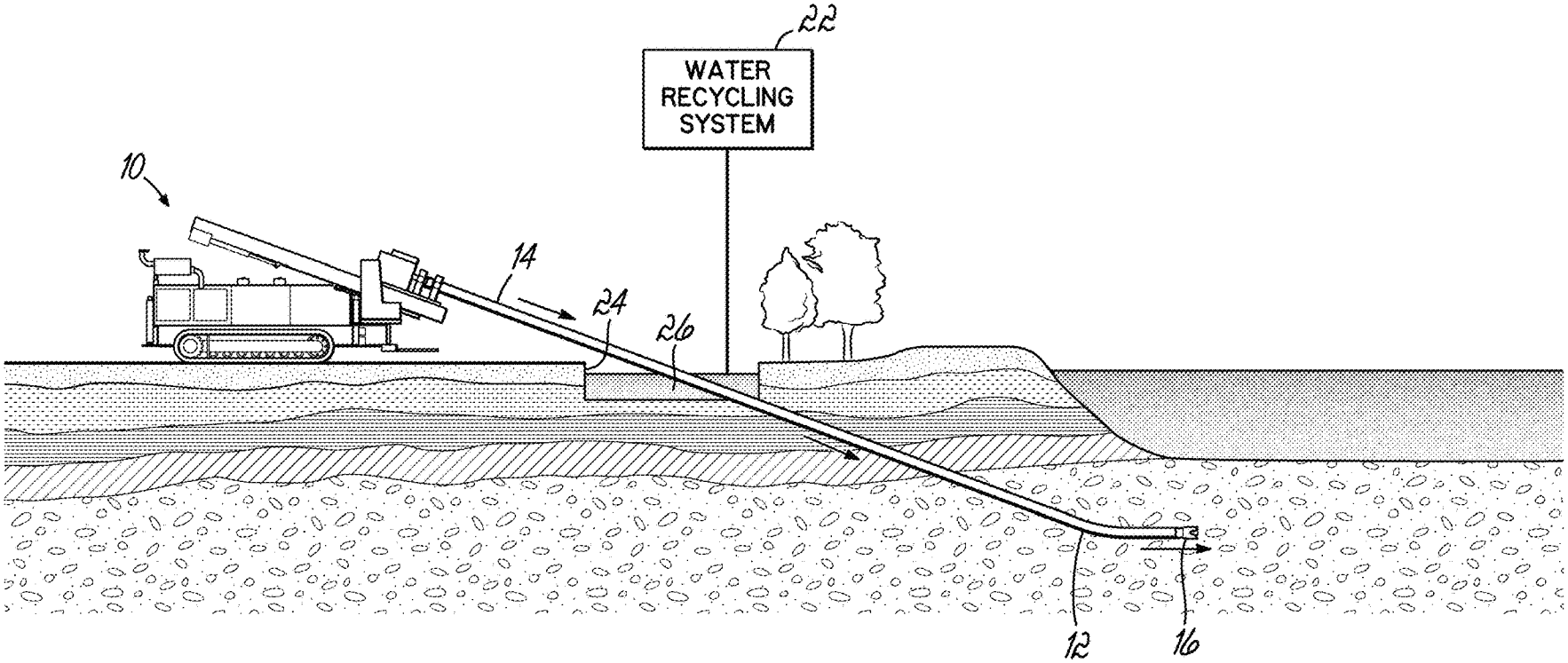
PRIOR ART FIG. 1
FIG. 1 is a schematic view showing a general overview of how conventional horizontal directional drilling (HDD) applications function, particularly in the pilot bore boring stage.
Figure 2A:
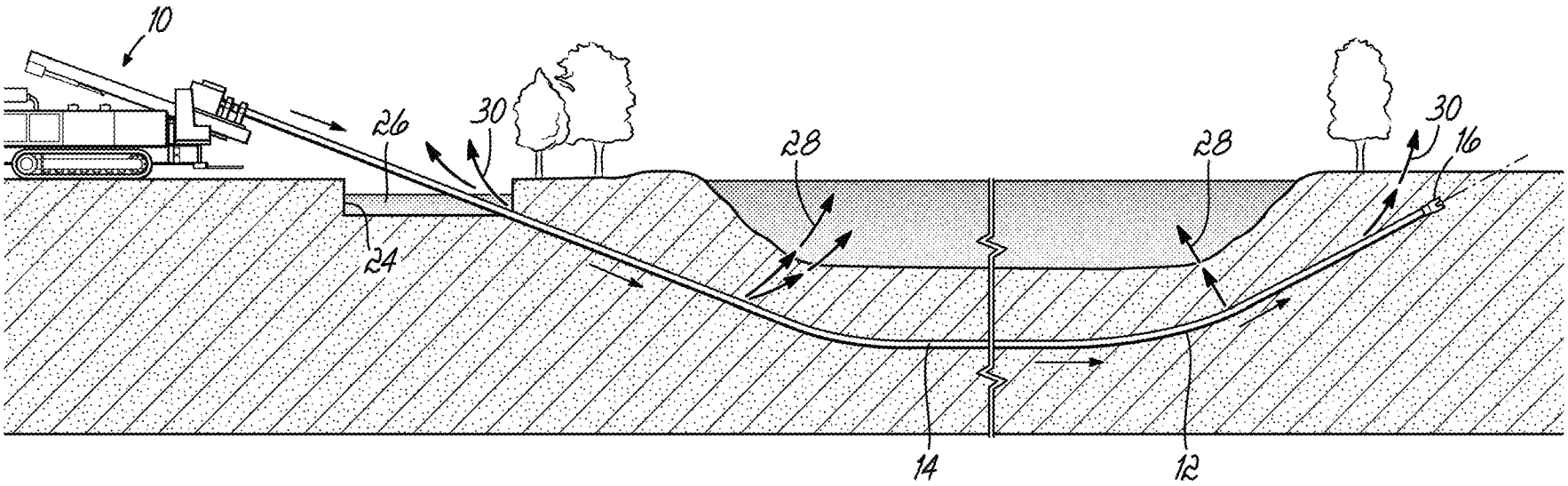
PRIOR ART FIG. 2A
FIG. 2A is another schematic view showing a further step in the conventional HDD drilling process, in which the pilot bore is further advanced along a desired path, with potential "frac outs" shown that may occur when using drilling fluid in HDD applications.
Figure 2B:
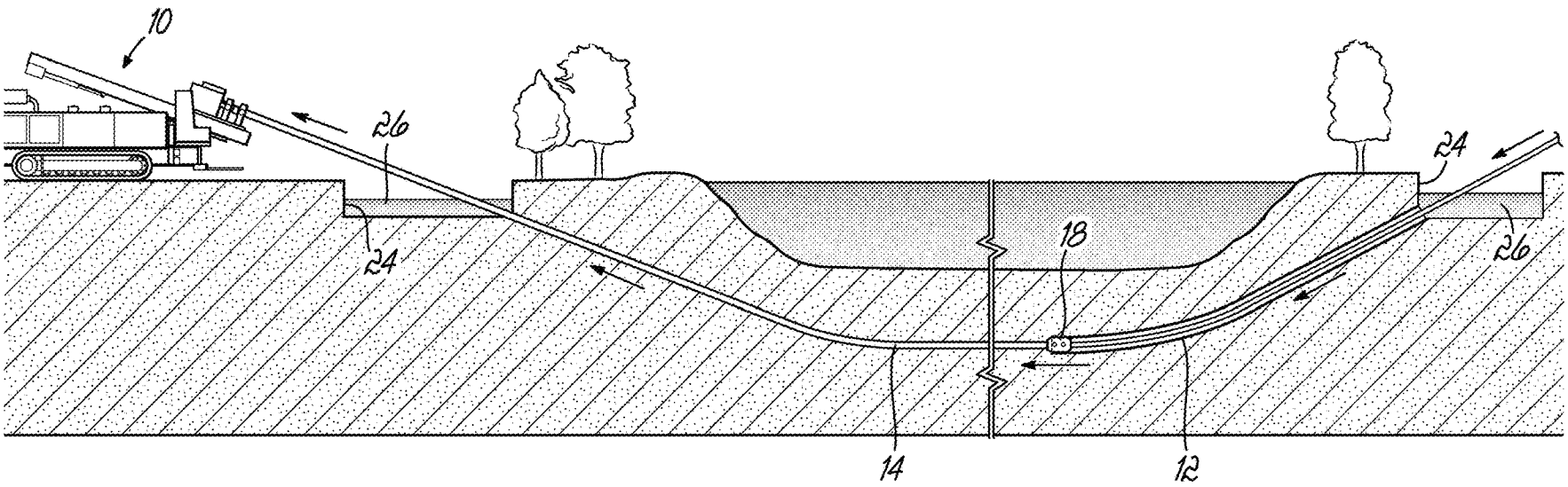
PRIOR ART FIG. 2B
FIG. 2B is a further schematic view showing a further step in the conventional HDD process, in which further steps of reaming and/or swabbing are being conducted.
Figure 2C:
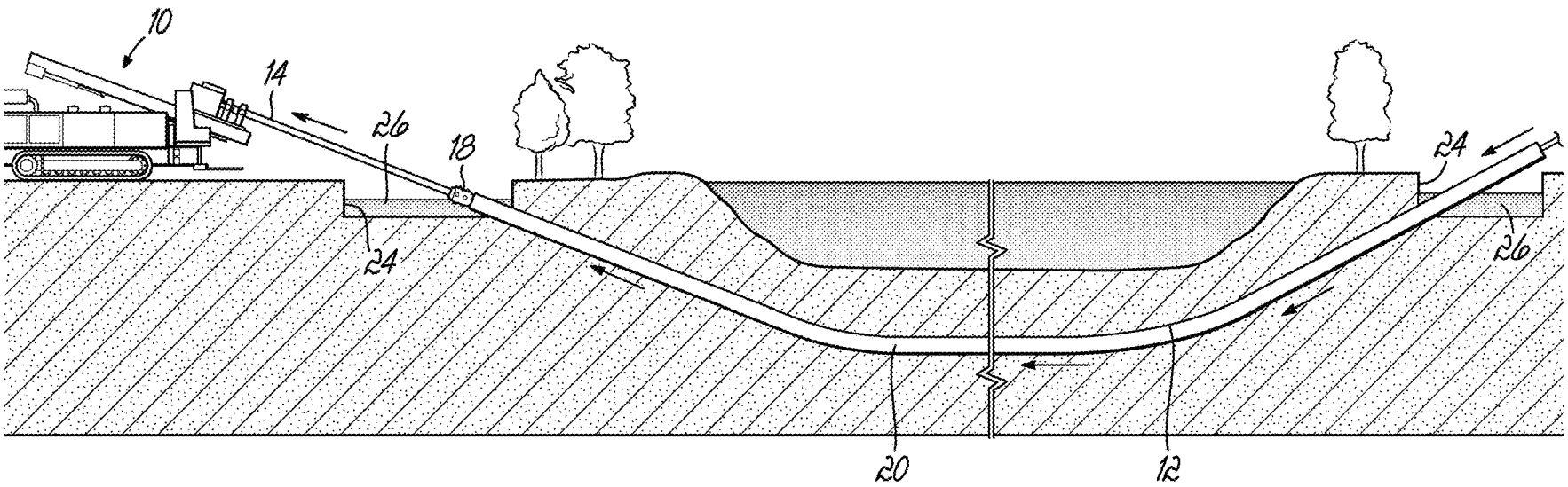
PRIOR ART FIG. 2C
FIG. 2C is yet another schematic view showing a further step in the conventional HDD process, in which a line or conduit is being installed in the bore along the desired path.

An improved horizontal directional drilling ("HDD") process for installing utility line(s) for one or more services is provided in accordance with the following description. Notably, the inventors have applied use of a sonic drill to the HDD process to enhance the reliability and efficiency of this HDD process. Using the sonic drill allows for various geological formations to be successfully cut through and penetrated during formation of the bore hole with no changes necessary in the drilling equipment, with corresponding increases in speed of advancing the sonic drill bit along the desired path for the utility lines to be installed. To this end, variations in the underground geological formation along the desired borehole path can be handled when using sonic-powered HDD methods without causing significant delay and reconfiguration of the drilling equipment during the process. Additionally and unexpectedly, such bore hole formation is accomplished without need for circulation of drilling fluid, or alternatively, with only a minimized amount of drilling fluid use. The HDD using sonic energy is capable of generating accurate bore hole paths for utility line installation without the known risks and technical problems encountered as a result of trench-digging or use and containment of significant amounts of drilling fluid during the HDD process.

As set forth generally above, the inventors of this application have now applied sonic drilling to the HDD context. Generally, a sonic drilling method uses a sonic drill head which includes a mechanism for vibrating a drill pipe or drill string/rod. One preferred mechanism for generating the vibrations is an oscillator mounted on the drill and adapted to transmit sinusoidal pressure waves through the drill pipe to thereby create a cutting action at the bit face. The oscillator may include, for example, one or more pairs of rotating weight elements contained within cavities such that counter-rotations of the weight elements relative to one another (e.g., one clockwise and another counterclockwise within the cavities) generates a high frequency vibration, such as up to 150 Hz, that is transmitted and applied to the drill string and therefore also to the sonic drill bit at the leading end of the drill string. A pneumatic isolation system may be used to insulate the remainder of the sonic drill head and rig from this energy so that it can be directed for maximum effect on the drill string.

The sonic frequency energy or vibrations generated by the oscillator are controlled by the drill operator to be generally what's called a resonant frequency for the underground formation being bored through at the sonic drill bit. To this end, when the sonic energy applied coincides with a natural frequency of the drill string, resonance occurs and this results in a maximum amount of energy transfer to the leading end of the sonic drill bit. The drill string and sonic drill bit are also slowly rotated during this process to help evenly distribute the energy and resulting impact on the sonic drill bit face. The advancement of the sonic drill head along the drill mast is performed in this embodiment by hydraulic down pressure created by flowing hydraulic fluid (on the drilling rig) to a hydraulic feed cylinder while also slowly applying rotation to the drill string and the aforementioned sonic energy. As with the percussive drilling method noted above, the sonic drill bit face may include carbide cutting bits that operate to cut through and remove material from in front of the sonic drill bit as a result of the rotation and application of sonic frequency energy. The resonant energy applied to the drill string also tends to suspend the soil or ground formation immediately adjacent the drill string, which minimizes friction applied against forward movements of the drill string as the sonic drill bit advances. The specific operation of sonic energy on various types of underground formations is described further below.

Figure 3:
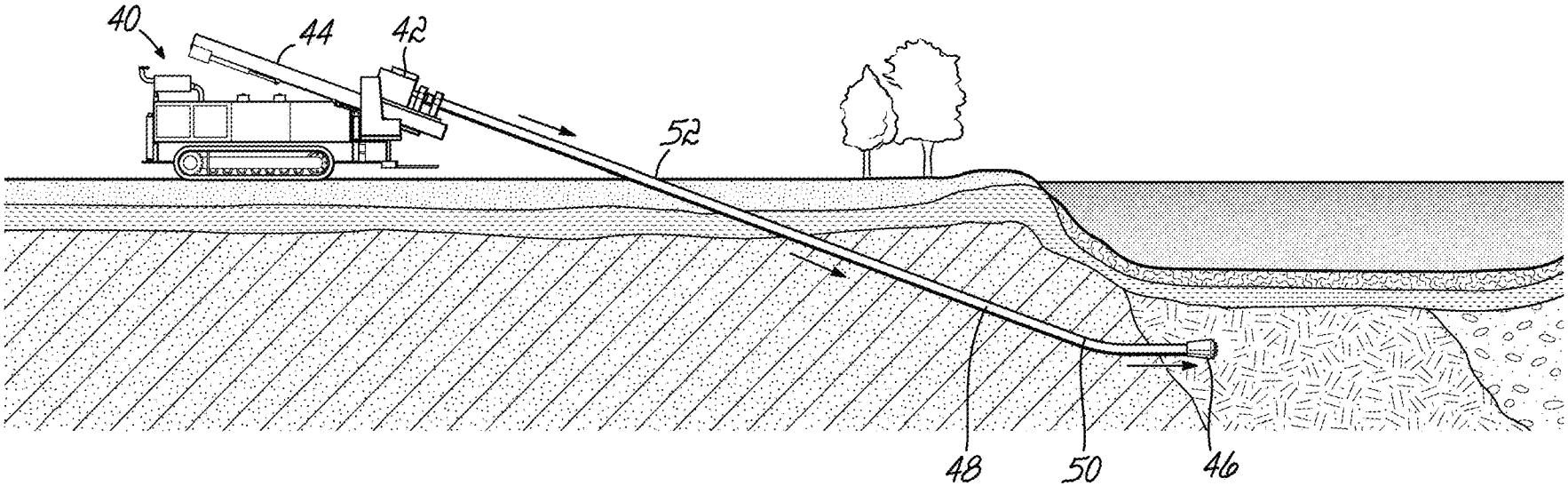
FIG. 3 is a schematic overview showing initial steps of forming a pilot bore using a sonic HDD process in accordance with embodiments of the invention.

Exemplary embodiments of combining the concepts of sonic drilling with an HDD operation are shown in the views of FIGS. 3 through 7, contrasted with the more generic views of standard HDD operation as previously shown. FIG. 3 shows a general overview of the setup for a drill site using sonic HDD. In this Figure, a track-mounted mobile sonic drill rig 40 (also referred to as a drilling apparatus 40 herein), which may specifically be a "Terra Sonic 150 Compact Crawler" commercially available from Terra Sonic of Marietta, Ohio, has been modified to operate in an HDD mode of operation. As with conventional HDD rigs, the sonic drill rig 40 moves a sonic drill head 42 along an angled drill mast 44 as shown so that a sonic drill bit 46 and a drill string made up of a series of sonic drill rods 48 (also known as drill steel) can be advanced through the ground in a substantially and/or completely horizontal manner. It will be understood that a bent sub (not shown in detail) is also connected between the sonic drill bit 46 and the foremost sonic drill rod 48 to allow for steering thereof, described further below. The sonic drill head 42 of the sonic drill rig 40 in FIG. 3 includes an oscillator (not shown) as described above and therefore applies high frequency sonic energy to cause drilling action and advancement of the sonic drill bit 46 and drill string. A storage rack of further sonic drill rods 48 would be positioned in close proximity to where the sonic drill rig 40 is operating so that as pieces of the sonic drill rod 48 are advanced into the ground, additional portions can be added and then advanced by longitudinal movement of the sonic drill head 42 along the drill mast 44. Such sonic drill rods 48 or portions can be manually positioned for connection to the existing drill string and the sonic drill head 42 or alternatively an automated lift and positioning system (not shown) can be used. This process of advancing the drill string and inserting a new drill string portion/member repeats until the pilot bore 50 has been drilled along the entirety of the desired path.

Moreover, the sonic HDD process may also advantageously include installation of sonic drill casings 49 (first seen in FIG. 4A) as well along the pilot bore 50. The sonic drill casings 49 are of a larger diameter than the size of the sonic drill bit 46 and can be advanced so as to remain only a few feet behind the operations of the sonic drill bit 46, although this positioning is not shown in the highly-schematic views provided in FIGS. 3 through 4C. The sonic drill casings 49 are installed using the same application of sonic energy/vibrations and slow rotations with the sonic drill head 42 (e.g., the sonic drill head 42 independently applies vibrations, rotation, and advancement movement to either the drill string (sonic drill rods 48) or to the sonic drill casings 49). Once installed, the sonic drill casings 49 solidify the pilot bore 50 to prevent any collapse thereof while also preventing any possibility of a "frac out" when drilling fluids are to be used in the process. It will be understood that in embodiments where sonic drill casings 49 are used in this manner, the process of advancing the drill string will alternate between securing a new sonic drill rod section to the sonic drill head 42 and advancing the sonic drill bit 46 and sonic drill rods 48, and securing a new sonic drill casing section to the sonic drill head 42 and then advancing the sonic drill casings 49. The storage rack described above may contain both sonic drill rods 48 and sonic drill casings 49 for ease and convenience of this alternating advancement to produce a "cased" pilot bore 50.

What can be seen in FIG. 3 is that the sonic drill bit 46 and sonic drill rods 48 have been advanced using the sonic drill rig 40 so as to penetrate into the ground at an entry site 52, as shown by the movement arrows in this FIG. 3. As will be described in further detail below (and also shown specifically in FIG. 7), no trench or pit is needed to be dug at the entry site 52 because the sonic HDD process does not require continuous circulation (or even any circulation, in some embodiments) of drilling fluid along the pilot bore 50. The sonic drill bit 46 moves at an angle downwardly until a depth of the desired generally horizontal path is reached, at which point the sonic drill bit 46 advances generally horizontally under the ground, and this permits the pilot bore 50 to traverse underneath environmental features such as sensitive areas (where trenches cannot be dug) or a river, as specifically shown in FIG. 3. It is also shown in FIG. 3 that the underground areas where the sonic drill bit 46 and the sonic drill rods 48 move through may be defined by various underground formations having different materials, an example of which will be described further below. The sonic HDD process allows for the same sonic drill bit 46 and drilling methodology to be used to successfully form the pilot bore 50 through each of these underground formations and materials.

Figure 4A:
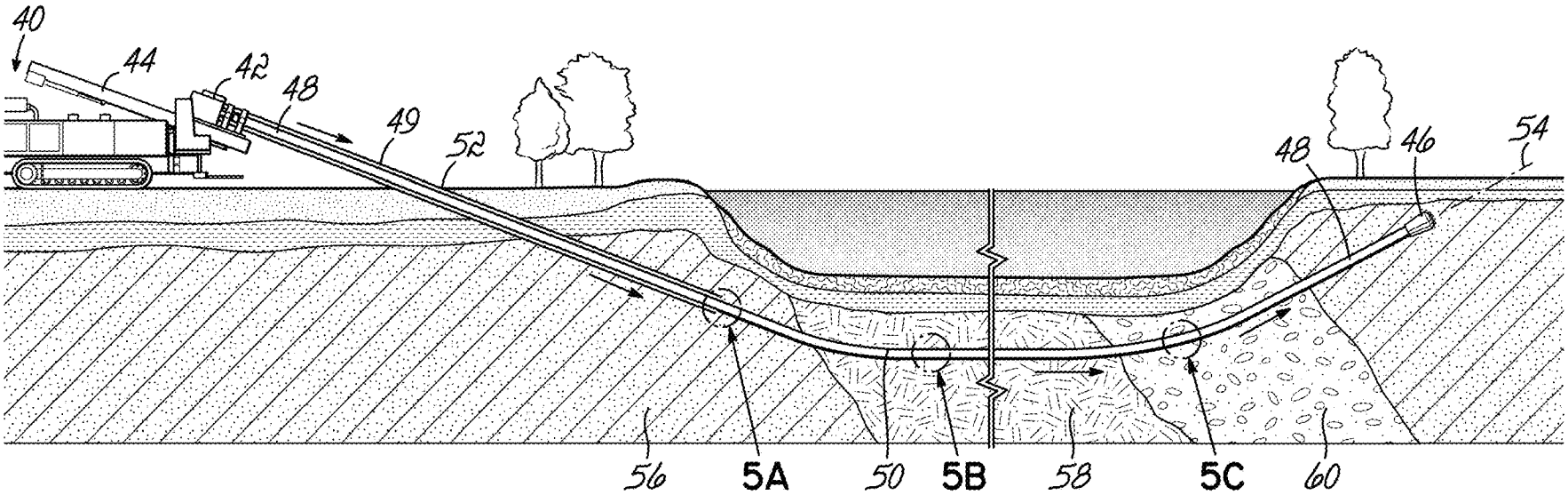
FIG. 4A is a further schematic view showing additional progress of advancing the sonic drill bit and sonic drill rods (as well as sonic drill casings) to form the pilot bore during the sonic HDD process, with the sonic drill bit penetrating through different underground formations and different materials shown by differing cross-hatchings along the desired path.
Figure 4B:
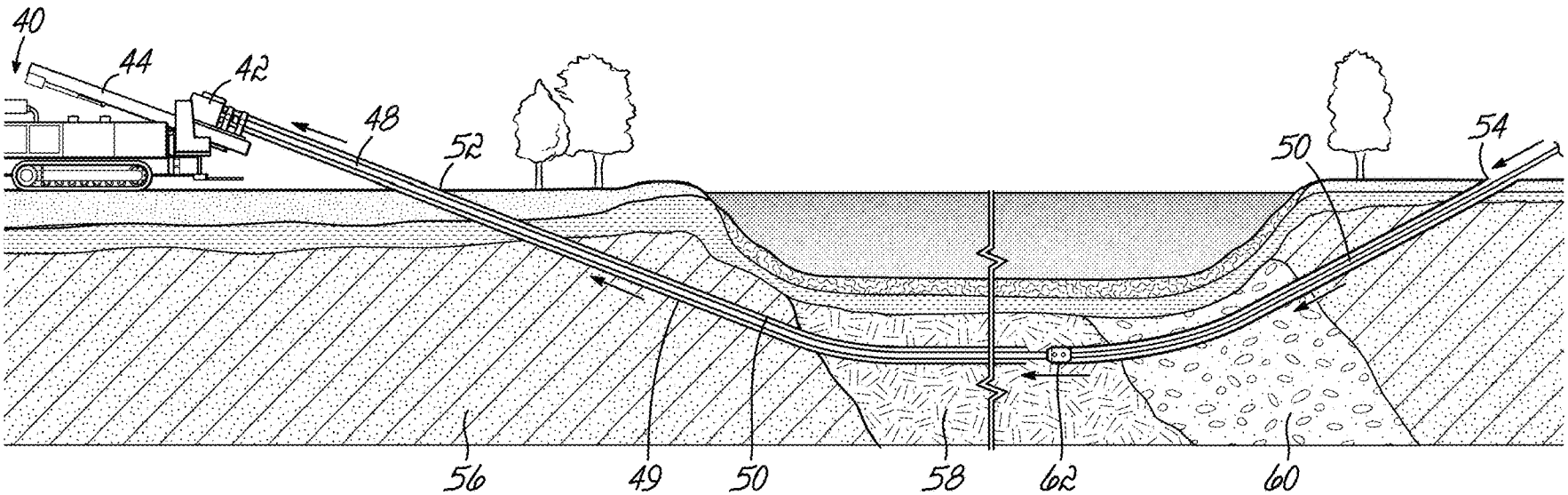
FIG. 4B is a further schematic view showing a further step in the sonic HDD process, in which further steps of reaming and/or swabbing are being conducted.
Figure 4C:
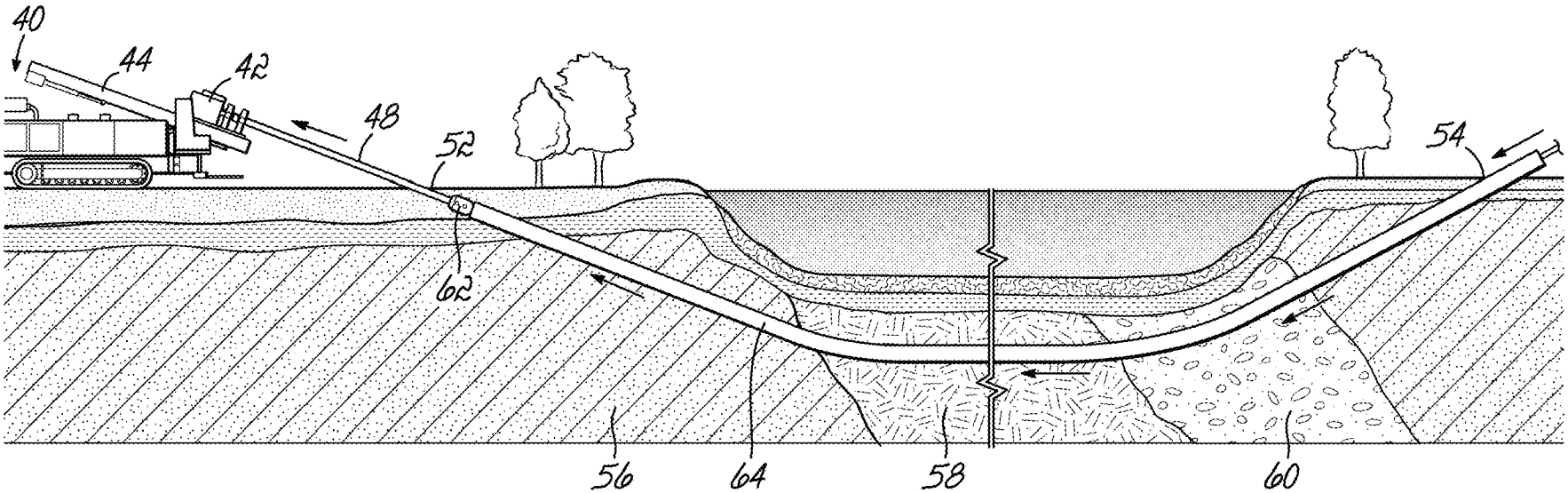
FIG. 4C is yet another schematic view showing a further step in the sonic HDD process, in which a line or conduit is being installed in the bore along the desired path.

Further steps of the sonic HDD process are shown with reference to FIGS. 4A through 4C. In FIG. 4A, the sonic drill bit 46 and the sonic drill rods 48 have continued to be advanced by the sonic drill rig 40 through most of the desired path, e.g., the sonic drill bit 46 in FIG. 4A is moving at an angle upwardly so as to emerge at an exit site 54 as also shown in FIG. 4B. Also shown in FIG. 4A, the sonic drill casings 49 have been installed over the sonic drill rods 48 along at least a portion of the pilot bore 50. It will be understood that when such sonic drill casings 49 are installed, they are typically installed in alternating sequence (contrary to what is shown in FIG. 4A for consistency with later FIG. 5A, described below) so that a substantial entirety of the pilot bore 50 is "cased" except for the couple of feet that the sonic drill bit 46 and sonic drill rods 48 project beyond a free end of the sonic drill casings 49. During the movement along the desired path to form the pilot bore 50, the sonic drill bit 46 and sonic drill rods 48 (as well as sonic drill casings 49) are advanced through at least two different underground formations located in this schematic view at different portions under the river shown. As set forth in further detail below, the different underground formations are defined by different materials, such as sand material at a first underground formation 56, rock material at a second underground formation 58, and clay material at a third underground formation 60. The sonic HDD process may cut through more or fewer variations of underground formations when making the pilot bore 50, depending on local geology and surface structure. The specifics of cutting through these different underground formations 56, 58, 60 are described further below with reference to detail views at FIGS. 5A through 5C, the detail circles being shown for reference in FIG. 4A.

The advancing movement of the sonic drill bit 46 and sonic drill rods 48 (and optionally the sonic drill casings 49) is shown by the movement arrows along the pilot bore 50 in FIG. 4A. After emerging from the exit site 54, which again does not require digging a trench or collection pit for drilling fluids, the sonic HDD process may continue in some embodiments by attaching one or more of a reamer 62 (also known as a back-reamer) or swabber to the free end of the drill string where the sonic drill bit 46 was connected. The advancing movements of the sonic drill rods 48 with the sonic drill rig 40 are repeated in reverse then, which withdraws the sonic drill rods 48 back through the pilot bore 50 section-by-section as shown by movement arrows in FIG. 4B. Where sonic drill casings 49 are also installed at the pilot bore 50, the sonic drill casings 49 are withdrawn in front of the typically-larger reamer 62 so as to not interfere with the further expansion of the bore, and this is shown by the location of the sonic drill casings 49 relative to the reamer 62 in FIG. 4B. Such withdrawal of the sonic drill rods 48 also moves the reamer 62 and/or swabber through the pilot bore 50 as shown at the bottom of FIG. 4B. The reamer 62 is configured to further cut through the underground formations to expand the diameter or size of the bore along the desired path, and such cutting is enhanced by the continued application of sonic energy with the sonic oscillator along the drill string. During this same movement or withdrawal step, the method may also include inserting the line or conduit 64 into the pilot bore 50 along the desired path, such as by having the line or conduit 64 be secured behind the reamer 62 to therefore follow into the pilot bore 50 as shown by the movement arrows in FIG. 4C. Once the reamer 62 and the line or conduit 64 have emerged again at the entry site 52, the sonic HDD process is complete with the line or conduit 64 fully installed along the desired path, which in this illustrated example is generally horizontally underneath a body of water like a river. Because no drilling fluid or only a minimal amount of drilling fluid is needed thanks to the application of sonic vibrations, there is no risk of "frac outs" or other environmental hazards during this process. Furthermore, the sonic HDD process installs the line or conduit 64 quickly regardless of the variations that may be present in underground formations and materials to be penetrated through.

In one alternative, where the sonic drill casings 49 are sufficiently large in size so that the line or conduit 64 to be installed can fit through the sonic drill casings 49, the step of pulling the reamer 62 or a swabber back through the desired path is not necessary. To this end, in such alternative embodiments the sonic HDD process can be completed by pulling (with the sonic drill rods 48) the line or conduit 64 back through the pilot bore 50 that remains "cased" by the sonic drill casings 49, and then the sonic drill casings 49 are thereafter removed following the finalized installation of the line or conduit 64.

Figure 5A:
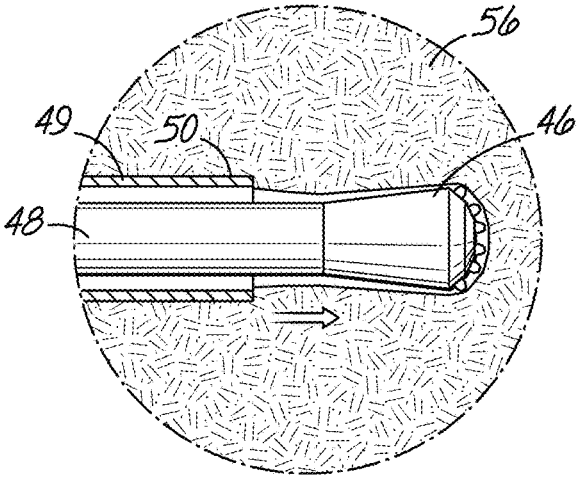
FIG. 5A is a detail view of the sonic drill bit and the foremost sonic drill rod and sonic drill casing as these separately/independently penetrate through a first underground formation (e.g., such as one made of sand material) along the desired path, and as noted at detail circle 5A in FIG. 4A.
Figure 5B:
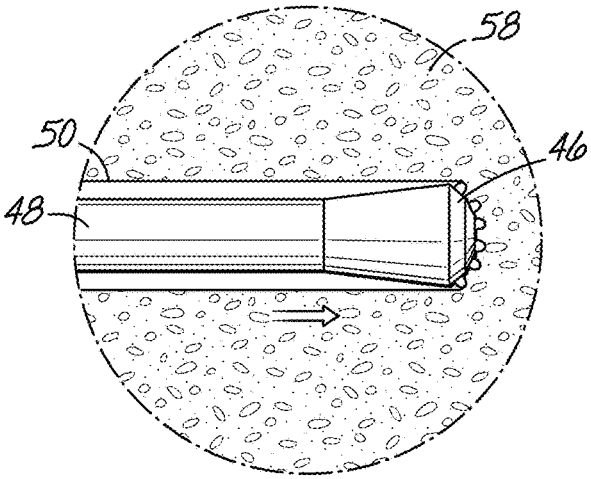
FIG. 5B is a detail view of the sonic drill bit and the foremost sonic drill rod as these penetrate through a second underground formation (e.g., such as one made of rock material) along the desired path, and as noted at detail circle 5B in FIG. 4A.
Figure 5C:
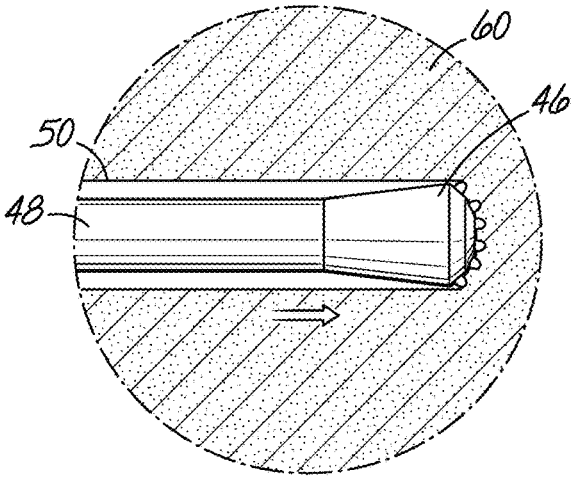
FIG. 5C is a detail view of the sonic drill bit and the foremost sonic drill rod as these penetrate through a third underground formation (e.g., such as one made of clay material) along the desired path, and as noted at detail circle 5C in FIG. 4A.

Now turning with reference to FIGS. 5A through 5C, the detail views showing how the same sonic drill bit 46 and drilling operations are used for the different underground formations 56, 58, 60 are shown in detail. In these illustrations, it will be understood that the sonic drill bit 46 is shown generally schematically, but in slightly more detail than in prior views. When a sand-based first underground formation 56 is encountered by the sonic drill bit 46 as shown in FIG. 5A, the sonic vibrations cause sand grains to suspend in space to allow for a generally frictionless or friction-light environment to advance along the desired path (as shown by the movement arrow). This type of movement may be referred to as "suspension advancement" of the sonic drill bit 46 and the sonic drill rods 48. Also visible in FIG. 5A, such sand-based formations are also where following the sonic drill bit 46 with installation of sonic drill casings 49 (a frontmost one shown in this Figure) help solidify and stabilize the pilot bore 50 within the soft formation. When a rock-based second geological formation 58 is encountered by the sonic drill bit 46 as shown in FIG. 5B, repeated impacts of the carbide cutting bits percussively fracture and remove rock material to allow advancement (as shown by the movement arrow), while again reducing frictional damping forces along the length of the drill string. When a clay-based third subsurface formation 60 is encountered by the sonic drill bit 46 as shown in FIG. 5C, the clay material is sheared using the sonic energy and this allows for reduced frictional damping forces along the length of the drill string following the sonic drill bit 46, thereby allowing for advancement as shown by the movement arrow in this view. In each of FIGS. 5B and 5C, it can be seen that the sonic drill rods 48 can advance without much friction because the sonic drill bit 46 used is slightly larger in diameter size than the sonic drill rods 48 (and/or the bent sub behind the sonic drill bit 46), for example, the sonic drill bit 46 in one embodiment can be about 5 inches in diameter and the sonic drill rods 48 are 3.5 inches in diameter, leaving a small gap about the periphery of the sonic drill rods 48. No reconfiguration is generally necessary of the equipment or of the operations of the sonic drill rig 40 when transitioning between these different types of underground geological formations, as each is automatically handled well by the application of sonic energy, thereby eliminating pauses and delays that may be encountered when using conventional HDD processes in the same context. Moreover, the borehole remains open and has good stability even without circulating drilling fluid to reinforce bore walls as a result of transmitting sonic energy/vibrations along the drill string, which allows for the unexpected result of true "dry" HDD being possible. These various benefits of sonic-powered HDD work both during initial pilot bore drilling as well as the subsequent reaming (and optional swabbing) passes through the desired path. Other types of materials and underground formations can also be handled by the sonic HDD process similarly, as these three are provided as exemplary embodiments only.

Figure 6A:
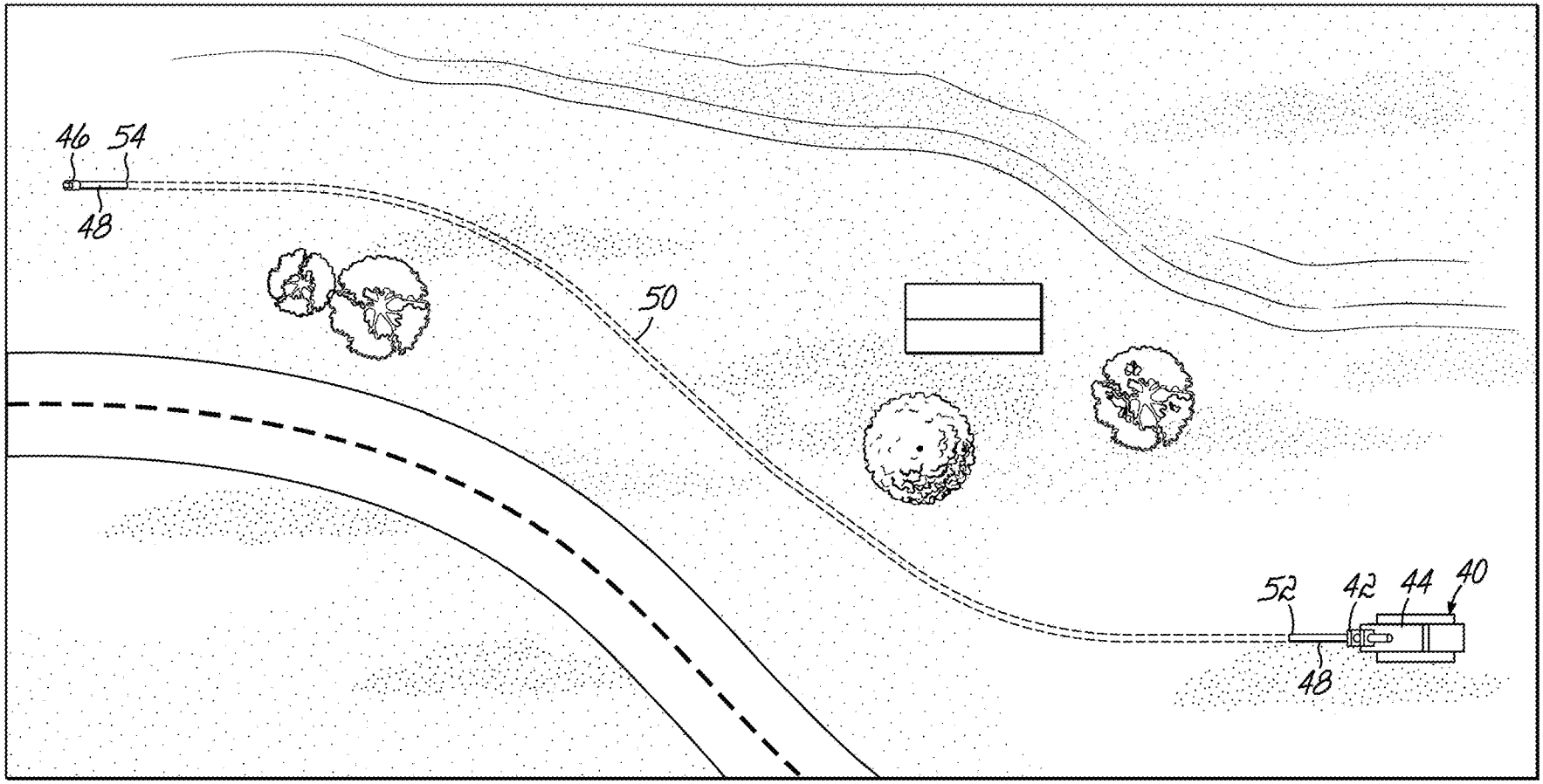
FIG. 6A is a top view that schematically illustrates the exemplary sonic HDD process in another embodiment, specifically to show turns that may be formed when advancing the sonic drill bit and sonic drill rods along the desired path.
Figure 6B:
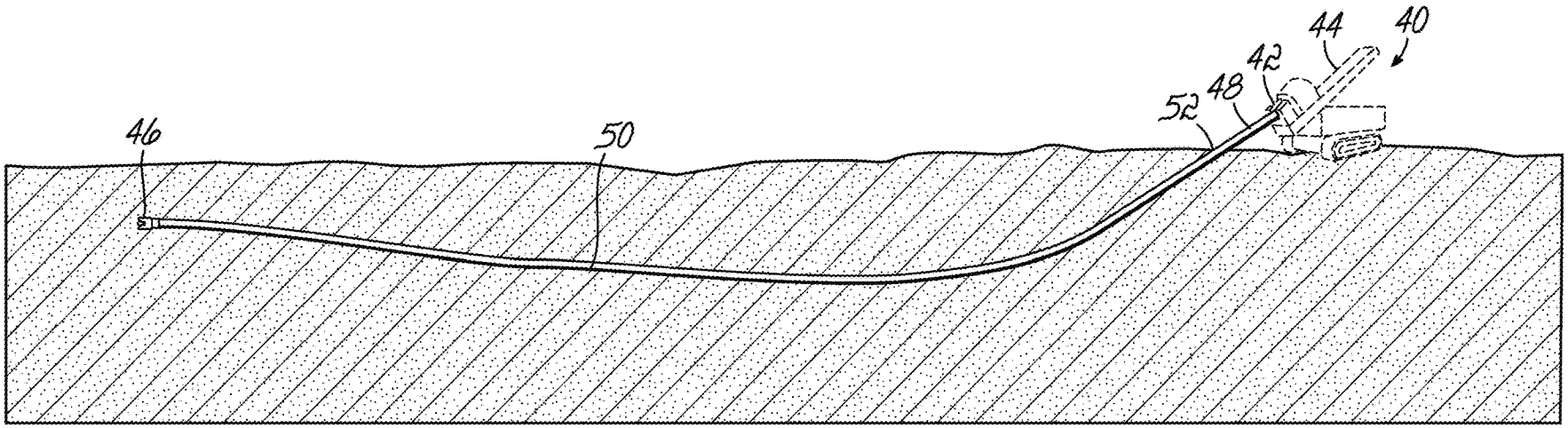
FIG. 6B is a side view that schematically illustrates another example of the sonic HDD process, such as a vertical profile of the pilot bore formed in the FIG. 6A example.

Another embodiment for the sonic HDD process is shown in FIGS. 6A and 6B, this being reflective of some testing done during proof-of-concept work for this process. In FIG. 6A, it can be seen that the advancing of the sonic drill bit 46 and the sonic drill rods 48 done by the sonic drill rig 40 includes turning a forward direction of the sonic drill bit 46 (e.g., using the bent sub) in a couple of places so as to follow a desired path for the pilot bore 50 that includes one or more turns. A bore path with two turns is shown from above in the example of FIG. 6A. The vertical profile of this test is shown in FIG. 6B, where it can be seen that the horizontal elevation of the pilot bore 50 can be adjusted as needed to follow the desired path as well as the lateral turns visible in FIG. 6A. The sonic drill casings 49 were also used in this test but have been omitted from the views here for simplicity.

Figure 7:
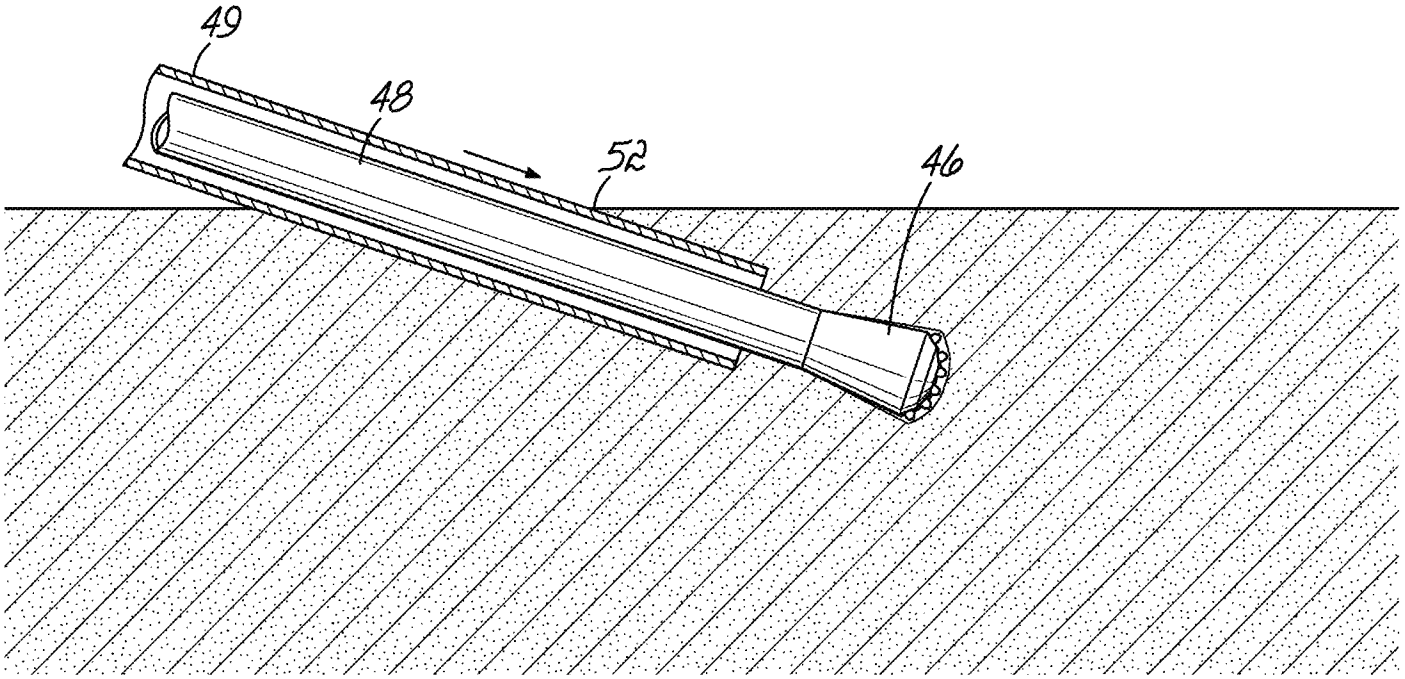
FIG. 7 is a detail side view of the sonic drill bit and a foremost sonic drill rod and sonic drill casing upon initial insertion into the ground at the entry site when starting the sonic HDD process.

With reference to FIG. 7, a beginning of the sonic HDD process with the sonic drill rig 40 is shown, with drillers preparing the lead element of the drill string (sonic drill rod 48) and the sonic drill bit 46 for initial insertion into the entry site 52 of the desired path or bore. As shown in this and the other views, an entry pit does not need to be dug at this jobsite because there is no need to use and reclaim a large amount of drilling fluids when using sonic in combination with sonic HDD. To this end, the drilling described in this process is successfully done "dry," meaning without drilling fluids. The sonic drill head 42 then proceeds to advance the sonic drill bit 46 and the sonic drill rods 48 into the ground along the desired path as described above, the advancement being done as a result of the application of sonic energy at high frequencies to fluidize and penetrate the underground formations in front of the sonic drill bit 46 as well as pull down force applied by movement of the sonic drill head 42 down the length of the drill mast 44. The sonic drill head 42 is then used to connect to and advance a sonic drill casing 49 into the ground so as to surround the sonic drill rod 48 as shown behind the sonic drill bit 46, and thereby to case the pilot bore 50 for the advantageous reasons explained above. Additional sonic drill rods 48 and sonic drill casings 49 are added for each pass of the sonic drill head 42 along the drill mast 44, with the sections being manually or automatically moved from the storage rack near the entry site to the sonic drill rig 40. The generally "dry" and reliable operation of the sonic HDD process is accomplished thanks to the combination of applying hydraulically-generated down pressure to move the sonic drill head 42 along the drill mast 44, slow rotations of the sonic drill bit 46 and sonic drill rods 48 with the sonic drill head 42, and application of sonic vibrations of up to 150 Hz, specifically applied in many circumstances to be adjusted to a resonant frequency of the sonic drill rods 48.

During some initial testing of the sonic-powered HDD process conducted by the inventors and referred to above, a generally horizontal bore path located 8 to 10 feet underground was successfully cut along over a 900 foot path length using the sonic drill rig 40, with at least two turns in the bore path as viewed in the example of FIG. 6A. In this testing, the accurate positioning and location of the sonic drill bit 46 was verified in some locations by digging a small trench to locate the current position of the sonic drill bit 46, but this confirmation of sonic drill bit position was only performed in testing because the downhole tracking elements (sonde) are not presently capable of reliably functioning in the context of sonic energy drilling applications. The bore path in testing was cut using sonic drilling and therefore no drilling fluid was necessary for the cutting/boring process. Thus, the use of a sonic powering by a sonic drill rig allows for successful HDD operations without as much equipment and space being necessary. In addition, several problems associated with use of drilling fluids in HDD are avoided, including less environmental damage caused by "frac outs" of drilling fluid at points between the entry and exit points of the desired path, and no issues presented with regard to sourcing the fluid, high consumption rates and recycling of the fluid, and/or freezing of fluids in certain drilling environments. Furthermore, the use of sonic energy causes forward advancement of the sonic drill bit faster than conventional HDD processes and rigs. These increases in speed reduce the overall time each pass of the sonic drill head along the drill mast takes, allowing for quicker installation and drilling of the bore hole.

Each of the sonic drill bit 46, the sonic drill rods 48, the sonic drill casings 49, and sonic drill head 42 in these examples is custom-tailored sonic equipment that is made to withstand the vibrations and use in this setting. For example, the sonic drill bit 46 is threaded onto the sonic drill rods 48 and the sonic drill rods 48 are threaded together with connection threads that can transmit sonic energy and not be disengaged unintentionally by such vibrational energies. The sonic drill bit 46 as shown most clearly in the schematics of FIGS. 5A-5C and 7 includes a front face with carbide cutting tips and a tapered cylindrical profile behind the front face, but it will be appreciated that this sonic drill bit 46 is just one design for accomplishing the sonic HDD process.

In summary, the use of a sonic drill and/or sonic energy assist on a HDD operation greatly improves the efficiency and predictability of using HDD technology for installation of utility line(s). The sonic powered HDD process causes less environmental harm, via both reduced consumption and fouling of water and/or drilling fluid as well as eliminating the risk of frac outs, while avoiding the need for additional equipment and pits at the jobsites associating with handling the drilling fluids. That reduces the space required while also lowering costs and makes drilling jobsites safer overall. The sonic powered HDD process successfully and quickly penetrates through many different types of underground formations and transitions between formations that may be encountered, especially along particularly long desired bore paths. With at least these technical benefits in combination, utility and drilling companies can better predict costs and timing of projects so as to avoid unnecessary disruptions to project timelines and the local area around the installation site.

While the invention has been illustrated by a description of various embodiments, and while these embodiments have been described in considerable detail, it is not the intention of the Applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the scope of the Applicant's general inventive concept.

What is claimed is:

1. A sonic-powered method for horizontal directional drilling, comprising:

positioning a drilling apparatus proximate to an entry site at one end of a desired path for a generally horizontal bore to be formed, the drilling apparatus including a sonic drill head movably mounted on a drill mast and a sonic oscillator operatively engaged with the sonic drill head;

attaching a sonic drill bit and a sonic drill rod to the sonic drill head;

advancing the sonic drill bit and the sonic drill rod into and through the ground along the desired path by advancing the sonic drill head to move along the drill mast, wherein the sonic oscillator applies sonic energy defined by high frequency vibrations to the sonic drill rod and the sonic drill bit to cause the sonic drill bit to penetrate through an underground formation in front of the sonic drill bit along the desired path;

attaching further sonic drill rods to the sonic drill head and to at least one previously-advanced sonic drill rod(s) and repeating the advancing of the sonic drill head to continue forming a generally horizontal bore by horizontal directional drilling along the desired path until the sonic drill bit emerges at an exit site at an opposite end of the desired path, wherein the generally horizontal bore formed by the advancing along the desired path defines a pilot bore for installing a line or conduit along the desired path;

attaching a sonic drill casing to the sonic drill head, the sonic drill casing being larger in diameter than the sonic drill bit and sonic drill rods;

advancing the sonic drill casing into and through the ground so that the sonic drill casing surrounds the sonic drill rods and the pilot bore as the sonic drill casing is installed, wherein the sonic oscillator applies sonic energy defined by high frequency vibrations to the sonic drill casing to cause the sonic drill casing to penetrate through the underground formation(s) in front of the sonic drill casing; and attaching further sonic drill casings to the sonic drill head and to at least one previously-advanced sonic drill casing(s) and repeating the advancing of the sonic drill head to continue casing the pilot bore, thereby stabilizing the walls of the pilot bore to prevent collapse of the pilot bore and/or to prevent escape of any drilling fluids used in the pilot bore, wherein the sonic drill head alternates between advancing one sonic drill rod and then one sonic drill casing such that the majority of the pilot bore is stabilized and cased behind the sonic drill bit during the horizontal directional drilling, and wherein the sonic drill head independently and separately applies the sonic energy to the sonic drill rods or to the sonic drill casings.

2. The method of claim 1, wherein the advancing of the sonic drill bit and the sonic drill rods into and through the ground is performed without a continuous circulation of a drilling fluid to the sonic drill bit and along the pilot bore.

3. The method of claim 2, wherein the advancing of the sonic drill bit and the sonic drill rods into and through the ground is performed without circulating any drilling fluid to the sonic drill bit or along the pilot bore.

4. The method of claim 3, wherein no fluid collection trench or water recycling equipment is provided at either of the entry site or the exit site during the horizontal directional drilling.

5. The method of claim 1, wherein the desired path for the pilot bore travels through at least two different underground formations defined by differing materials to drill through, and the advancing of the sonic drill bit and the sonic drill rods into and through the ground further comprises:

using the same sonic drill bit to penetrate through each of the differing materials in the at least two different underground formations.

6. The method of claim 5, wherein a single set of drilling equipment including the same sonic drill bit and a single set of drilling operation parameters is used for penetrating the pilot bore through each of the at least two different underground formations.

7. The method of claim 5, wherein one of the different underground formations is defined by sand material, and the step of advancing the sonic drill bit and the sonic drill rods further comprises:

suspending sand grains of the sand material in space using transmission of sonic vibrations from the sonic drill bit and the sonic drill rods into the sand material, thereby generating a low friction environment for the sonic drill bit to advance through the sand material.

8. The method of claim 7, wherein another one of the different underground formations is defined by clay material, and the step of advancing the sonic drill bit and the sonic drill rods further comprises:

shearing the clay material surrounding the sonic drill bit and the sonic drill rods with transmission of sonic vibrations from the sonic drill bit and the sonic drill rods into the clay material, thereby reducing friction against forward movements of the sonic drill bit and the sonic drill rods.

9. The method of claim 8, wherein another one of the different underground formations is defined by rock material, and the step of advancing the sonic drill bit and the sonic drill rods further comprises:

percussively fracturing the rock material by applying sonic vibrations to the sonic drill bit to cause repeated impacts of the sonic drill bit into the rock material, thereby removing the rock material in front of the sonic drill bit and reducing friction against forward movements of the sonic drill bit and the sonic drill rods.

10. The method of claim 1, further comprising:

inserting the line or conduit into the cased pilot bore and pulling the line or conduit through the pilot bore to finalize installation of the line or conduit along the desired path; and withdrawing the sonic drill casings using the drilling apparatus after the line or conduit is installed along the desired path.

11. The method of claim 1, wherein the sonic oscillator produces high frequency vibrations of up to 150 Hz in the sonic drill bit and the sonic drill rods, or in the sonic drill casings.

12. The method of claim 11, further comprising:

adjusting output of the sonic oscillator such that a frequency of the high frequency vibrations applied by sonic energy on the sonic drill rods is a resonant frequency of the sonic drill rods, or such that the frequency applied on the sonic drill casings is a resonant frequency of the sonic drill casings.

13. The method of claim 1, wherein advancing the sonic drill bit and the sonic drill rods further includes turning a forward direction of the sonic drill bit with a bent sub such that the desired path of the pilot bore includes one or more turns along a length of the desired path.

14. The method of claim 1, further comprising:

after the sonic drill bit emerges from the exit site to finalize formation of the pilot bore, attaching a reamer and/or a swabber to a free end defined by the sonic drill rods; and withdrawing the sonic drill rods back through the pilot bore to advance the reamer and/or the swabber along the pilot bore, wherein the sonic oscillator of the drilling apparatus continues to apply high frequency vibrations to the sonic drill rods to assist the reamer and/or the swabber to cut through the underground formations surrounding the pilot bore and thereby expand a size of the pilot bore to fit the line or conduit to be installed along the desired path.

15. The method of claim 14, further comprising:

inserting the line or conduit into the expanded pilot bore and pulling the line or conduit through the pilot bore to finalize installation of the line or conduit along the desired path.

16. The method of claim 1, wherein in addition to applying sonic energy with the sonic oscillator, advancing the sonic drill bit and the sonic drill rods with the sonic drill head further comprises:

applying hydraulically-generated down pressure to move the sonic drill head along a length of the drill mast towards the entry site; and slowly rotating the sonic drill bit and the sonic drill rods with the sonic drill head during movement of the sonic drill head along the length of the drill mast.

* * * * *